United States Patent [19]

Marsh

[11] 4,231,350

[45] Nov. 4, 1980

[54] HOT WATER BOILER

[76] Inventor: Dean E. Marsh, 512 N. 4th St., Belen, N. Mex. 87002

[21] Appl. No.: 926,401

[22] Filed: Jul. 20, 1978

[51] Int. Cl.[3] ..... F24B 9/04; F22B 33/02

[52] U.S. Cl. ..... 126/133; 126/31; 126/365; 122/37

[58] Field of Search ..... 126/133, 132, 344, 369.2, 126/364, 365, 350, 120, 121, 21, 345, 31, 361, 362; 122/37, 22

[56] References Cited

U.S. PATENT DOCUMENTS

| | | | |
|---|---|---|---|
| 390,743 | 10/1888 | Backus | 126/133 |
| 1,118,656 | 11/1914 | Labedzki | 126/31 |
| 1,458,876 | 6/1923 | Confer | 126/365 X |
| 1,495,321 | 5/1924 | Gelder | 122/37 X |
| 2,554,338 | 5/1951 | Levine | 122/37 |
| 2,607,335 | 8/1952 | Harding | 126/365 X |
| 2,627,252 | 2/1953 | Mohn | 122/37 |
| 2,643,322 | 6/1953 | Lime et al. | 126/361 X |
| 2,644,432 | 7/1953 | Hummel | 126/361 X |
| 3,955,556 | 5/1976 | Pangborn et al. | 126/350 R X |
| 4,030,302 | 6/1977 | Mankouski | 122/37 X |
| 4,050,626 | 9/1977 | Awalt, Jr. | 126/132 X |
| 4,126,118 | 11/1978 | Haynes | 126/132 X |

FOREIGN PATENT DOCUMENTS

| | | | |
|---|---|---|---|
| 85867 | 3/1896 | Fed. Rep. of Germany | 126/31 |
| 584246 | 2/1925 | France | 126/31 |
| 797647 | 5/1936 | France | 126/344 |
| 7435237 | 5/1976 | France | 126/133 |
| 1254770 | 11/1971 | United Kingdom | 126/350 |

*Primary Examiner*—Samuel Scott
*Assistant Examiner*—Randall L. Green
*Attorney, Agent, or Firm*—Clarence A. O'Brien; Harvey B. Jacobson

[57] ABSTRACT

A hot water boiler having a dual combustion chamber arrangement capable of burning either solid or fluid fuels, and arranged for acting directly on a heat transfer system generally in direct contact with firebox walls of the combustion chamber arrangement. Disposed atop the combustion chamber arrangement is a heat conserving flue assembly which absorbs heat from smoke and flue gases exhausted from the combustion chamber arrangement and heats a fluid medium which in turn is circulated to the heat transfer means for eventual release for circulation or storage as desired in a residence or other building structure. The heat transfer system includes a fluid containing cavity divided into two parts by a suitable membrane, with pipes being provided penetrating the membrane for permitting transfer of the fluid medium from one part of the cavity to the other, with the heat transfer fluid medium thus being initially heated in the flue assembly, transferred to a first, or uppermost, part of the cavity of the heat transfer system, and subsequently transferred to the lower part of the heat transfer system and discharged entirely from the boiler structure.

3 Claims, 10 Drawing Figures

22
62
65
63
24
64
P
26
50
50
20
40
38
48
48
34
46
40
18
W
38'
36
54
56

20
65
64
24
63
22
62
62
60
64
28
P
70
50
50
42
48
48
40
40
46
52
44
18
58
36
54
56

HOT WATER BOILER

BACKGROUND OF THE INVENTION

1. Field of the Invention

This invention relates generally to hot water boilers, and particularly to the construction of a wet base hot water boiler heating apparatus having the capability of using various kinds of fuels either singly or in conjunction with each other.

2. Description of the Prior Art

Examples of previous heat extraction principles involving fire places found in prior patents include the use of air conduction as disclosed in U.S. Pat. Nos.: 1,371,390, issued Mar. 15, 1921 to J. S. Olds; 3,053,455, issued Sept. 11, 1962 to G. E. Eichenlaub; 3,744,477, issued July 10, 1973 to G. M. Andrews; and 3,965,865, issued June 29, 1976 to C. H. Nelson. In addition, U.S. Pat. No. 2,185,665, issued Jan. 2, 1940 to C. H. Ham, discloses a fireplace having a water-filled hollow double-walled shell disposed therein in which shell water is heated, while U.S. Pat. No. 3,394,697, issued July 30, 1968 to J. W. Lewis discloses a fireplace heating system built around an endless copper tube having an inlet and an outlet, with the water flow being controlled and the entire heat exchanger being attached on a metal frame so as to serve as a fireplace grate. Another example of a fireplace heat exchanger wherein the grate itself circulates a heat transfer medium can be found in U.S. Pat. No. 3,945,369, issued Mar. 23, 1976 to W. H. Adams et al.

An example of a multi-chamber boiler can be found in U.S. Pat. No. 2,894,493, issued July 14, 1959 to M. J. De Leonardis, which discloses a device in the form of a series of nesting chambers surrounding a heat source.

In a conventional hot water boiler, cold water is fed from the bottom of the boiler. After the hot water has picked up its greatest temperature, most of the heat above this point is lost up the flue of the device to contribute greatly to the waste of energy inherent in such conventional boilers. The consensus of opinion seems to be that a substantial amount of the heat generated by the combustion of fuels goes up the chimney of a fireplace, and the like.

SUMMARY OF THE INVENTION

It is an object of the present invention to provide a hot water boiler construction which will result in the conservation of natural resources, and which will permit the efficient use of fuels in more abundant supply but heretofore not utilized as completely as possible due to inconvenience in handling.

It is another object of the present invention to provide a hot water boiler capable of more efficient heat extraction, both domestically and industrially, than capable with known devices of this kind.

Still another object of the present invention is to provide a hot water boiler system capable of recovering vast amounts of waste heat, especially industrial waste heat.

A still further object of the present invention is to provide a hot water boiler capable of recovering vast amounts of waste heat energy which normally escapes up the chimney or stack of a fireplace, wood burning stove, gas furnace, and the like.

These and other objects are achieved according to the present invention by providing a hot water boiler having: a combustion chamber arrangement; a heat transfer system disposed adjacent the combustion chamber arrangement for transferring heat from the combustion chamber arrangement to a circulating fluid medium; and a heat conserving flue assembly associated with the combustion chamber arrangement for absorbing heat from smoke and flue gases being exhausted from the combustion chamber arrangement and heating the circulating fluid medium which is subsequently transferred to the heat transfer system.

The flue assembly preferably includes a jacket arranged surrounding a stack extending upwardly from the combustion chamber arrangement, with the jacket itself extending upwardly along a vertical extent of the stack and concentric shells cooperate with the stack and jacket to form a cavity containing a heat transfer fluid medium and a cavity for combustion products. A conduction tube is arranged extending into the fluid medium cavity and upwardly along the extent of the stack for conveying the heat transfer fluid medium into the cavity from an external source, such as the return line from a hot water heating or dispensing circulating system.

The flue assembly advantageously further includes a gas vent line extending substantially parallel and in spaced relation to the stack with this vent line being in communication with the combustion chamber arrangement and with the combustion products cavity for transferring heat therefrom to the heat transfer fluid medium disposed within the fluid medium cavity of the flue assembly. More specifically, the combustion chamber arrangement is a dual firebox construction containing a solid fuel burning firebox and a combustion area in which is disposed a gas burner, and the like. The vent line is in communication with the gas burner combustion area for exhausting combustion products therefrom, with both the solid fuel firebox and the gas burner being arranged so as to directly heat fluid medium within the heat transfer system of the boiler.

The heat transfer system preferably includes a housing arranged partially surrounding, and supporting, the combustion chamber arrangement and forming a reservoir for the heat transfer fluid medium. A baffle is provided within the housing for partitioning the reservior into at least two parts, with a passage arrangement being disposed within the housing and traversing the baffle for permitting fluid flow through the baffle. The heat transfer fluid medium is transferred from the flue assembly to the reservoir of the heat transfer system by a connecting control tube attached in communication with and extending between the fluid medium cavity of the flue assembly and the reservoir of the housing of the heat transfer system. The baffle includes a horizontally disposed, impervious membrane, with the passage arrangement comprising at least one pipe extending vertically through the membrane from a point substantially above the plane of the membrane to a point substantially below same, with the control tube terminating below an upper end of the pipe. A hot fluid medium outlet is provided in the housing below the level of the membrane for permitting the heated fluid medium, such as water, to be exhausted from the boiler structure.

By this arrangement, it will be appreciated that incoming fluid medium to be heated is initially warmed by waste heat exiting the combustion chamber arrangement through the flue assembly according to the invention, with such heated fluid medium being subsequently transferred downwardly, under the influence of pressure, to the reservoir disposed in the housing of the heat transfer system where the fluid medium passes first to the upper and then to the lower of the parts of the reservoir for being progressively heated to a higher temperature by direct contact with heat being transmitted into the area of the reservoir from the combustion chambers themselves. Extension of the cavity of the housing beneath the solid fuel firebox forms what is generally referred to as a "wet base" construction, with the gas burner, and the like, being disposed beneath this wet base.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
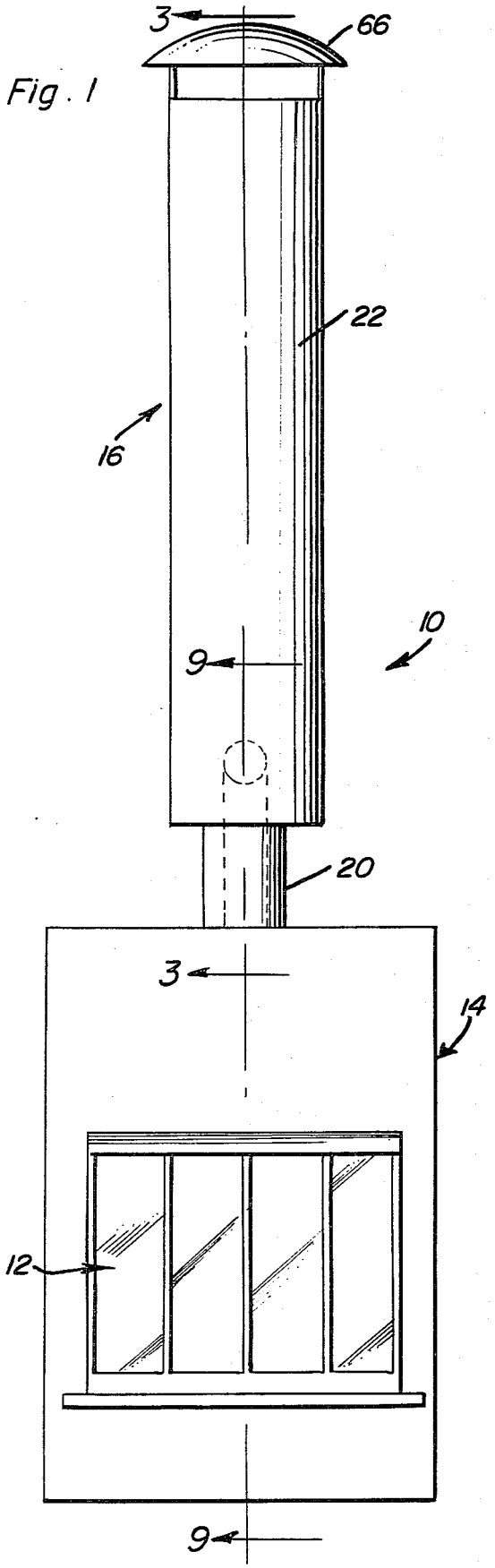
FIG. 1 is a schematic, front elevational view showing a hot water boiler according to the present invention.
Figure 2:
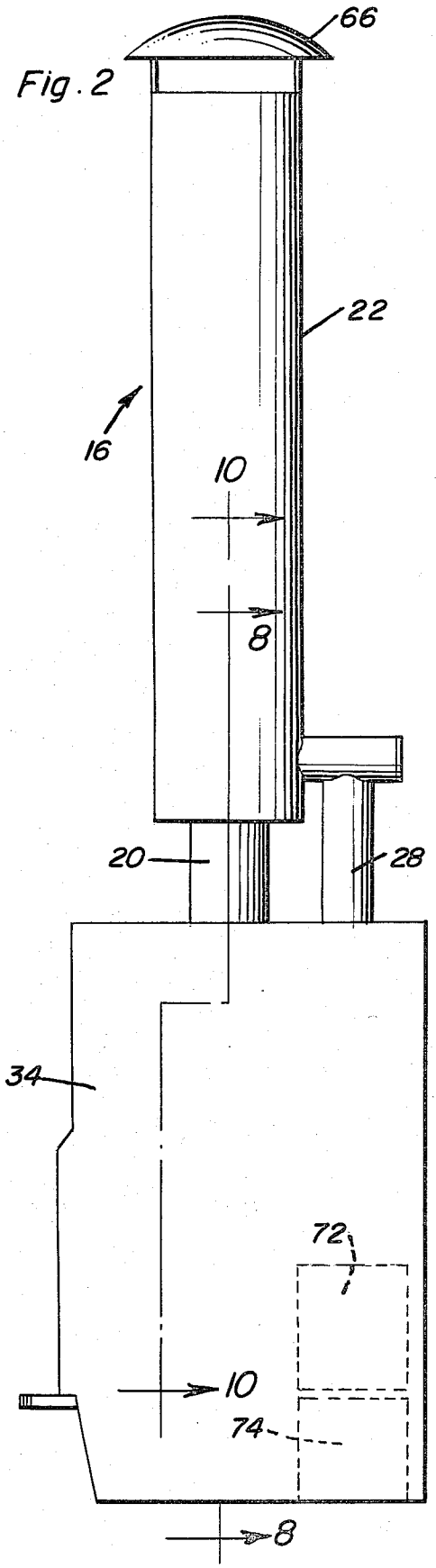
FIG. 2 is a schematic, side elevational view, looking from the right in FIG. 1.
Figure 3:
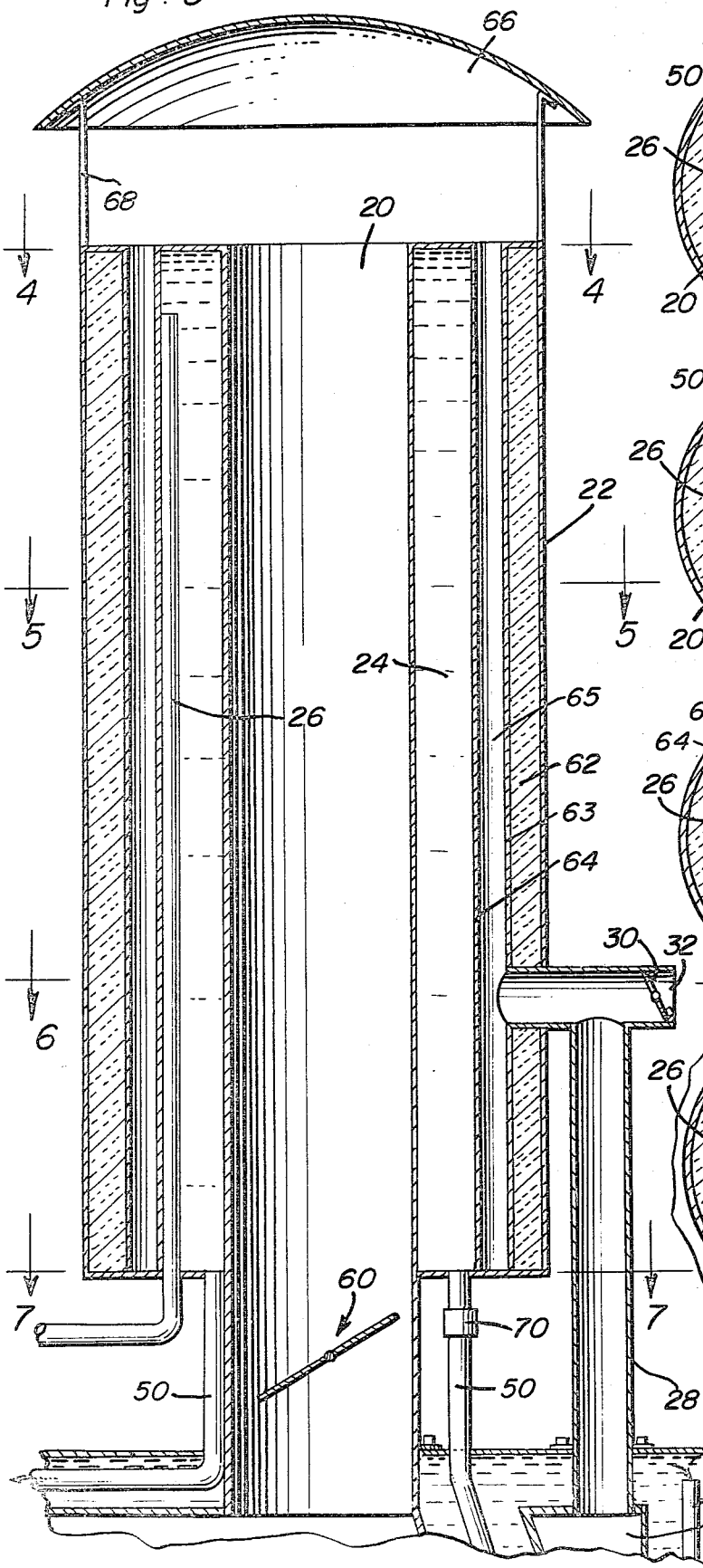
FIG. 3 is an enlarged, fragmentary, schematic, sectional view taken generally along the line 3—3 of FIG. 1.
Figure 4:
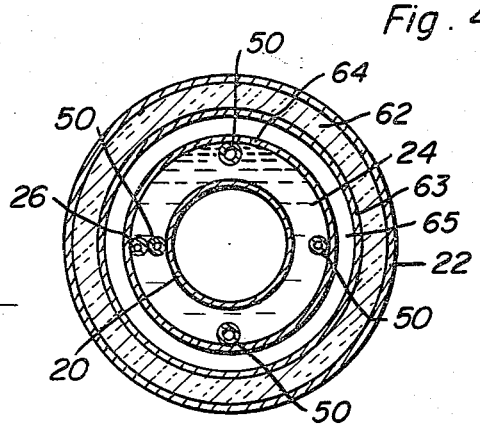
FIG. 4 is a sectional view, drawn to reduced scale, taken generally along the line 4—4 of FIG. 3.
Figure 5:
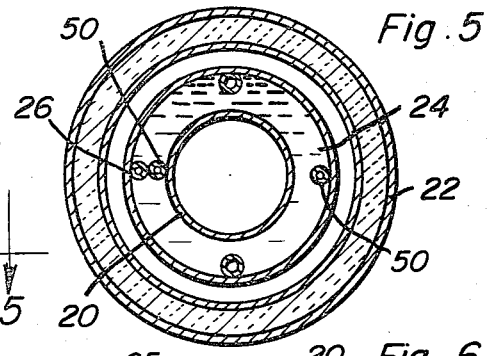
FIG. 5 is a sectional view, drawn to reduced scale, taken generally along the line 5—5 of FIG. 3.
Figure 6:
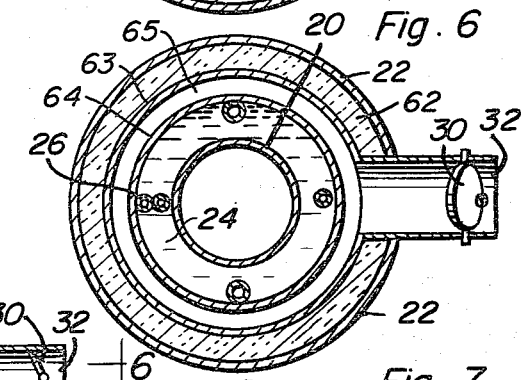
FIG. 6 is a sectional view, drawn to reduced scale, taken generally along the line 6—6 of FIG. 3.
Figure 7:
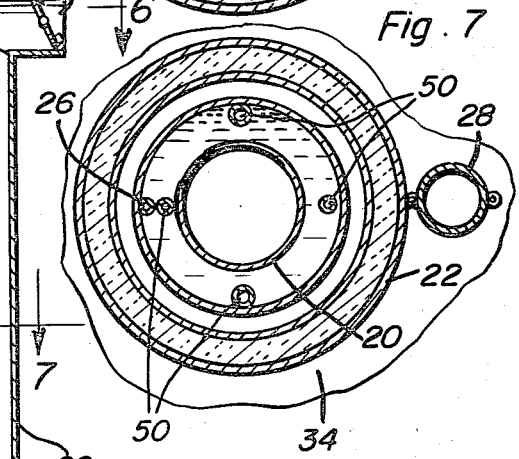
FIG. 7 is a sectional view, drawn to reduced scale, taken generally along the line 7—7 of FIG. 3.
Figure 8:
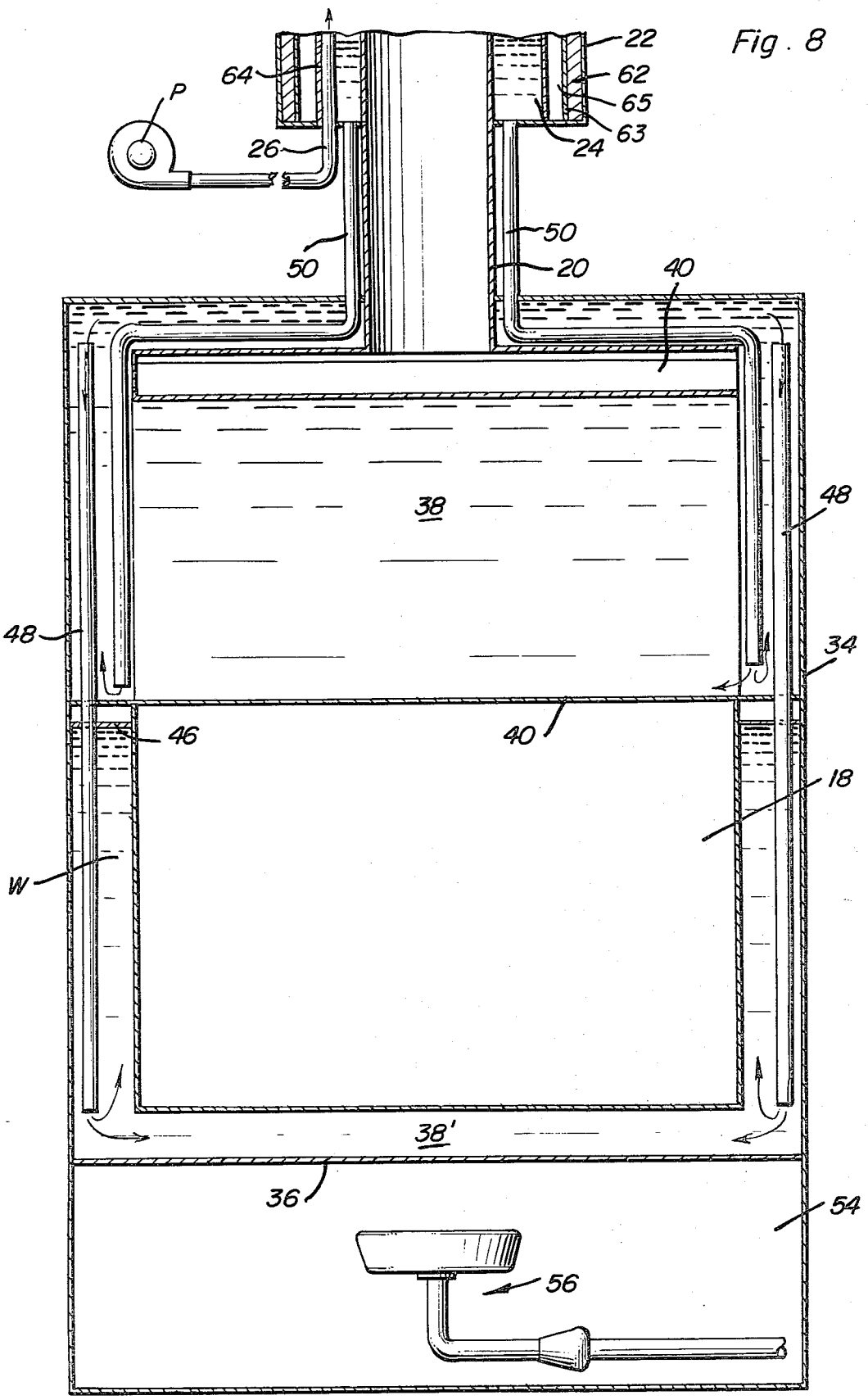
FIG. 8 is an enlarged, fragmentary, schematic, sectional view taken generally along the line 8—8 of FIG. 2.
Figure 9:
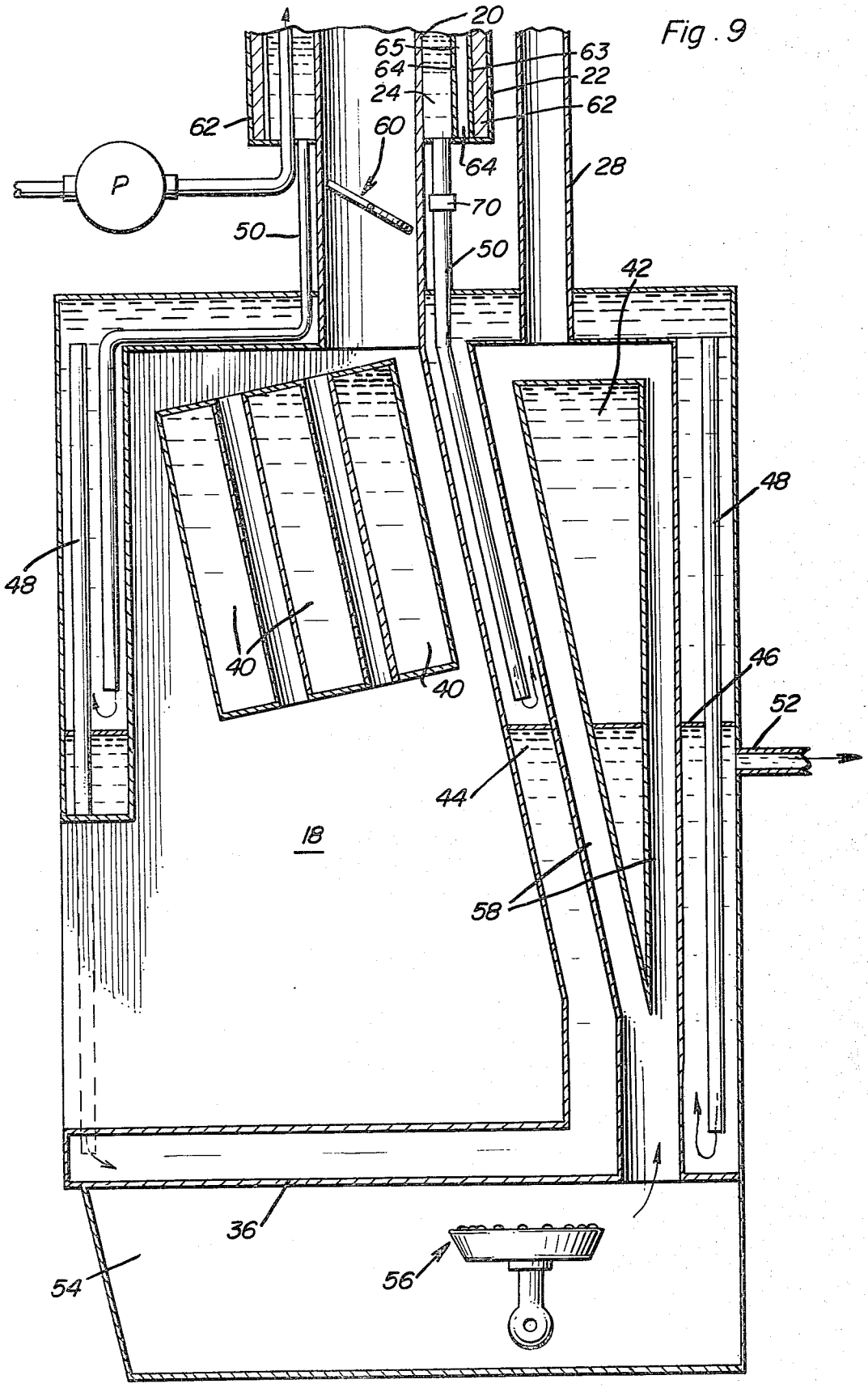
FIG. 9 is an enlarged, fragmentary, schematic, sectional view taken generally along the line 9—9 of FIG. 1.
Figure 10:
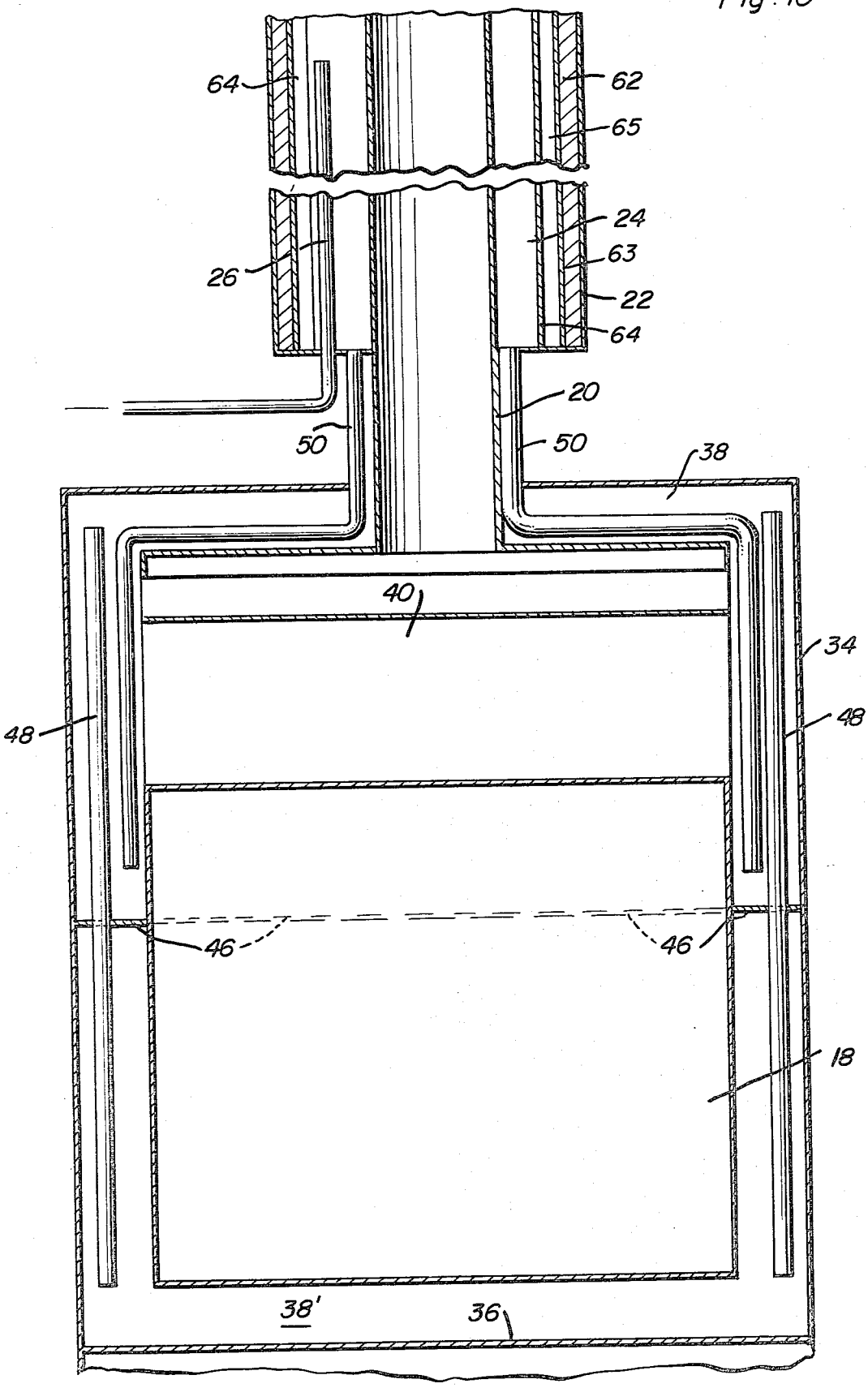
FIG. 10 is an enlarged, fragmentary, schematic, sectional view, with several parts and the fluid medium removed for clarity, taken generally along the line 10—10 of FIG. 2.

Referring now more particularly to the Figures of the drawings, a hot water boiler 10 according to the present invention includes a combustion chamber arrangement 12 disposed within a heat transfer system 14 so as to cause heat of combustion from arrangement 12 to be readily transferred into a fluid medium, such as water W, circulating through system 14. A heat conserving flue assembly 16 is disposed above heat transfer system 14, and is arranged in communication with combustion chamber arrangement 12 for absorbing heat from smoke, flue gases, and the like, being exhausted from arrangement 12. As will become clear below, a fluid medium, such as water W to be heated by the boiler 10 is fed into flue assembly 16 where the medium passes downwardly through heat transfer system 14 to eventual discharge from boiler 10 so as to be permitted to circulate through a hot water heating and/or dispensing system, or to be put into a suitable storage tank.

Combustion chamber arrangement 12 includes a solid fuel firebox 18 generally in the form of a conventional fireplace firebox and provided with a stack 20 extending vertically from the top of firebox 18. Flue assembly 16 is partially formed by the stack 20 and an outer, substantially cylindrical jacket 22. Immediately adjacent the outer periphery of stack 20 is a generally annular cavity 24 which extends substantially throughout the extent of stack 20 so as to be terminated by the generally horizontally disposed upper wall portion of jacket 22. At least one water inlet tube 26 extends into cavity 24 of jacket 22 so as to disposed along the extent of stack 20 for conveying the fluid medium to be heated from pump p for discharge into the uppermost portion of the cavity 24.

Flue assembly 16 further includes a combustion product vent line 28 extending substantially parallel to the extent of stack 20 and in spaced relation thereto, with line 28 being in communication with combustion area 54 through divided passage 58 and with annular space 65 defined by concentric shells 63 and 64. A damper 30 of conventional construction is provided at the 90-degree bend in line 28 outwardly of jacket 22 so as to selectively block and unblock an air passage 32 provided in line 28. Since the purpose and operation of damper 30 is as conventionally employed in gas burner venting systems, and the like, its operation will not be described in detail herein. The jacket or shell 22, shells 63 and 64 and stack 20 are all concentric cylindrical members with both ends of the stack being open and only the top end of cavity 65 being open.

Heat transfer system 14 includes a housing 34 arranged partially surrounding firebox 18, leaving only the fire-building access opening thereto, and includes a bottom wall 36 disposed substantially horizontally so as to form the base of a reservoir including parts 38 and 38'. A plurality of lateral ducts 40, 42 and 44 are provided extending horizontally across the upper portion of housing 34 in order to form a flow path within housing 34 of increased heat transfer surface relative to a fire within firebox 18. Extending horizontally across housing 34, substantially midway between an upper wall thereof and the bottom wall 36, is a baffle 46 which partitions the reservoir into the aforementioned two parts 38 and 38'. A passage system including a pair of pipes 48 is provided within housing 34, with the pipes 48 being arranged penetrating through the membrane formed by baffle 46 and permitting the fluid medium being heated to be transferred from adjacent the top of housing 34 to discharge immediately above the bottom wall 36.

Heat transfer system 14 further includes a plurality of connecting control tubes 50 attached in communication with and extending between the cavity 24 of flue assembly 16 and the upper reservoir part 38 formed within housing 34 of heat transfer system 14 for feeding heated fluid medium from flue assembly 16 to heat transfer system 14. As mentioned above, baffle 46 includes a horizontally disposed, impervious plate forming a membrane across housing 34, with an outlet 52 being provided in a vertical wall of housing 34 immediately beneath baffle 46 for permitting discharge of heated water W, or other suitable fluid medium, from the lower reservoir part 38'.

Beneath wall 36 of housing 34, and forming a base for the portions of housing 34 disposed thereabove, is the combustion area 54 in which is disposed a conventional gas burner 56, and the like. The divided passage arrangement 58, forming the lateral duct 42, connects combustion area 54 to the combustion product vent line 28. As will be appreciated, the lateral ducts 42 and 44 are themselves bisected by baffle 46.

A suitable damper 60 is disposed within the lower portion of stack 20 for controlling the draft through the stack 20 in a manner well known.

Flue assembly 16 further includes a cylindrical layer of insulation 62 disposed between jacket 22 and shell 63, with the annular space or cavity 65 formed between the inner surface of the shell 63 and the cylindrical shell 64 forming a second stack communicating with the combustion products vent line 28 and which is closed at the bottom and open at the top.

A concave deflector 66 is preferably arranged opening downwardly above the top of flue assembly 16, and held in spaced relationship above the top of stack 20 and cavity 65 as by the illustrated rods 68. The purpose of such a deflector 66 is well known, such deflectors being commonly employed from the top of stacks, as is the purpose of coupling 70 provided in the tube 50.

Access doors 72 and 74 are conveniently located on a lower lateral side of housing 34 to permit ready access to combustion area 54 for suitable purpose, such as adjustment and maintenance of an automatic control system (not shown) associated with gas burner 56.

OPERATION

A boiler 10 according to the present invention has the capability of burning combustible solids, liquids and gaseous fuels. The burning of combustible solids is set up for one chamber, specifically firebox 18, whereas the burning of combustible gases or liquids is provided in the other combustion chamber, specifically in the combustion areas 54. A discussion of the burners or controls needed therefor shall not be set forth herein, since such burners and their controls are well known and commonly employed. Nevertheless, it is understood that all controls and equipment used shall be capable of performing their task and shall be safety oriented. A further consideration is that a choice of fuels is only dependent on availability, desirability and economics. The ability to use different fuels made possible by a boiler 10 according to the invention will allow the use of crop produced fuels such as wood-pulp, corncobs, and the like, with the advantage that when the user gets tired of firing manually, one can be assured that the unit will automatically begin to utilize gaseous or liquid fuels. Thus, energy is being conserved together with a resulting reduction in cost to the user. That is, the multi-fuel capability of boiler 10 allows use of the most fuel available. Prudent fuel storage assures heating ability even during disasters.

The multi-compartments of the circulation system according to the invention allows a reverse style circulation. Using a water medium for pumped heat transfer, the heat extraction process begins in the highest extraction chamber or cavity 24 which forms a water jacket around stack 20. Also, heat is extracted from combustion products passing upwardly in cavity 65 which, in effect, forms a second exhaust stack. It is then sent to the bottom of the intermediate heat stage below it, by way of the control tubes 50. After absorbing the heat in this chamber, or reservoir part 38, the water W overflows the top of this heat stage by way of the overflow control pipes 48 to the bottom of the heat stage below it. After the heat absorption occurs within this chamber, reservoir part 38', the hot water W either overflows into the bottom of an additional heat stage below it by way of another overflow control tube, such as the stage not being shown in the drawings, or is sent out of the system through a discharge port such as outlet 52. That is, the discharge of the heated medium may be performed from the top of any of the heat extraction chambers provided. Any number of such heat extraction stages may be employed, their size and shape being regulated by the application desired. Thus, each heat extraction stage absorbs its optimum heat and acts as a heat boosting principle to the next extraction stage below it. This principle also allows the application of different temperatures of hot water, dependent to one's need. This principle is also applicable to the largest industrial application needs. The essentials being compartmented water jackets with control tubing to direct pump water flow to obtain maximum heat absorption and efficiency. It is to be noted that this applies to hot water boilers only. This principle does not apply to steam applications.

SUMMARY

As can be readily understood from the above description and from the drawings, a hot water boiler according to the present invention permits water or other suitable fluid medium, to be heated as desired in a convenient manner from virtually any combustible fuel available. While specific operating controls, burners, and safety devices have not been specifically set forth herein, such devices are sufficiently well known and commonly employed as to make specific recitation thereof unnecessary. Only approved controls and equipment shall be used.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A liquid heating device comprising a combustion chamber, an exhaust stack extending upwardly from the combustion chamber and receiving combustion products from said combustion chamber, a liquid jacket associated with the combustion chamber in heat exchange relation thereto, a liquid jacket associated with the stack in heat exchange relation thereto, said liquid jacket associated with the combustion chamber including a horizontal partition defining upper and lower liquid reservoirs, a heated liquid outlet at an upper portion of the lower reservoir, a cold liquid inlet at an upper portion of the jacket associated with the stack, connecting tubes extending between and communicating a lower end of the jacket associated with the stack and a lower portion of the upper reservoir, and vertically elongated flow tubes extending between and communicating an upper portion of the upper reservoir and a lower portion of the lower reservoir whereby the liquid is heated in three vertically oriented stages from the inlet to the outlet.

2. The heating device as defined in claim 1 wherein said lower reservoir extends under the combustion chamber, a second combustion chamber under that portion of the lower reservoir which extends under the first mentioned combustion chamber, and a divided passage arrangement extending through both the upper and lower reservoirs and communicating with a second exhaust stack for passage of combustion products from the lower combustion chamber whereby the liquid is heated in three vertically oriented stages.

3. The heating device as defined in claim 2 wherein said upper reservoir includes a peripherally continuous portion enclosing an upper portion of the first mentioned combustion chamber and upper portions of the divided passage arrangement for combustion products from the lower combustion chamber, and a plurality of transversely extending, spaced liquid receiving passageways interconnecting opposite portions of the continuous peripheral portion of the upper reservoir, said transverse passageways being disposed in the path of movement of combustion products toward the stack.

* * * * *